United States Patent [19]

Krone

[11] Patent Number: 5,064,005

[45] Date of Patent: Nov. 12, 1991

[54] IMPACT HAMMER AND CONTROL ARRANGEMENT THEREFOR

[75] Inventor: John J. Krone, Dunlap, Ill.

[73] Assignee: Caterpillar Inc., Peoria, Ill.

[21] Appl. No.: 516,861

[22] Filed: Apr. 30, 1990

[51] Int. Cl.[5] ..... B25D 9/18

[52] U.S. Cl. ..... 173/134; 91/170 R; 91/243; 91/300

[58] Field of Search ..... 173/116, 134, 135; 91/243, 170 R, 300

[56] References Cited

U.S. PATENT DOCUMENTS

| | | | |
|---|---|---|---|
| 4,034,817 | 7/1977 | Okada | 173/134 |
| 4,149,602 | 4/1979 | James | 173/134 |
| 4,179,983 | 12/1977 | Wallace | 173/134 |
| 4,413,687 | 11/1983 | Eklöf | 173/134 |
| 4,474,248 | 10/1984 | Musso | 173/134 |
| 4,646,854 | 3/1987 | Arndt et al. | 173/134 |
| 4,676,323 | 6/1987 | Henriksson | 173/134 |
| 4,715,265 | 12/1987 | Graul et al. | 91/170 |
| 4,825,960 | 5/1989 | Krone | 173/134 |
| 4,945,998 | 8/1990 | Yamanaka | 173/134 |

FOREIGN PATENT DOCUMENTS

| | | |
|---|---|---|
| 0168364 | 1/1986 | European Pat. Off. . |
| 0236721 | 9/1987 | European Pat. Off. . |
| 0352742 | 1/1990 | European Pat. Off. . |
| WO80/01666 | 8/1980 | PCT Int'l Appl. . |

*Primary Examiner*—Mark Rosenbaum
*Assistant Examiner*—Scott A. Smith
*Attorney, Agent, or Firm*—John W. Grant

[57] ABSTRACT

Hydraulic hammers are normally controlled by an actuating valve which controls the flow of fluid from a source of pressurized fluid to the hydraulic hammer. During certain periods of operation, the actuating valve totally blocks communication of fluid to the hydraulic hammer, thereby causing the fluid from the source of pressurized fluid to be expelled through a relief valve. The subject hydraulic hammer and control arrangement therefor includes an accumulator for storing the pressurized fluid from the source of pressurized fluid during periods of fluid blockage by the actuating valve and for supplementing the flow of fluid from the source of pressurized fluid when the actuating valve is communicating pressurized fluid to the hydraulic hammer. This increases the overall efficiency thereof.

2 Claims, 1 Drawing Sheet

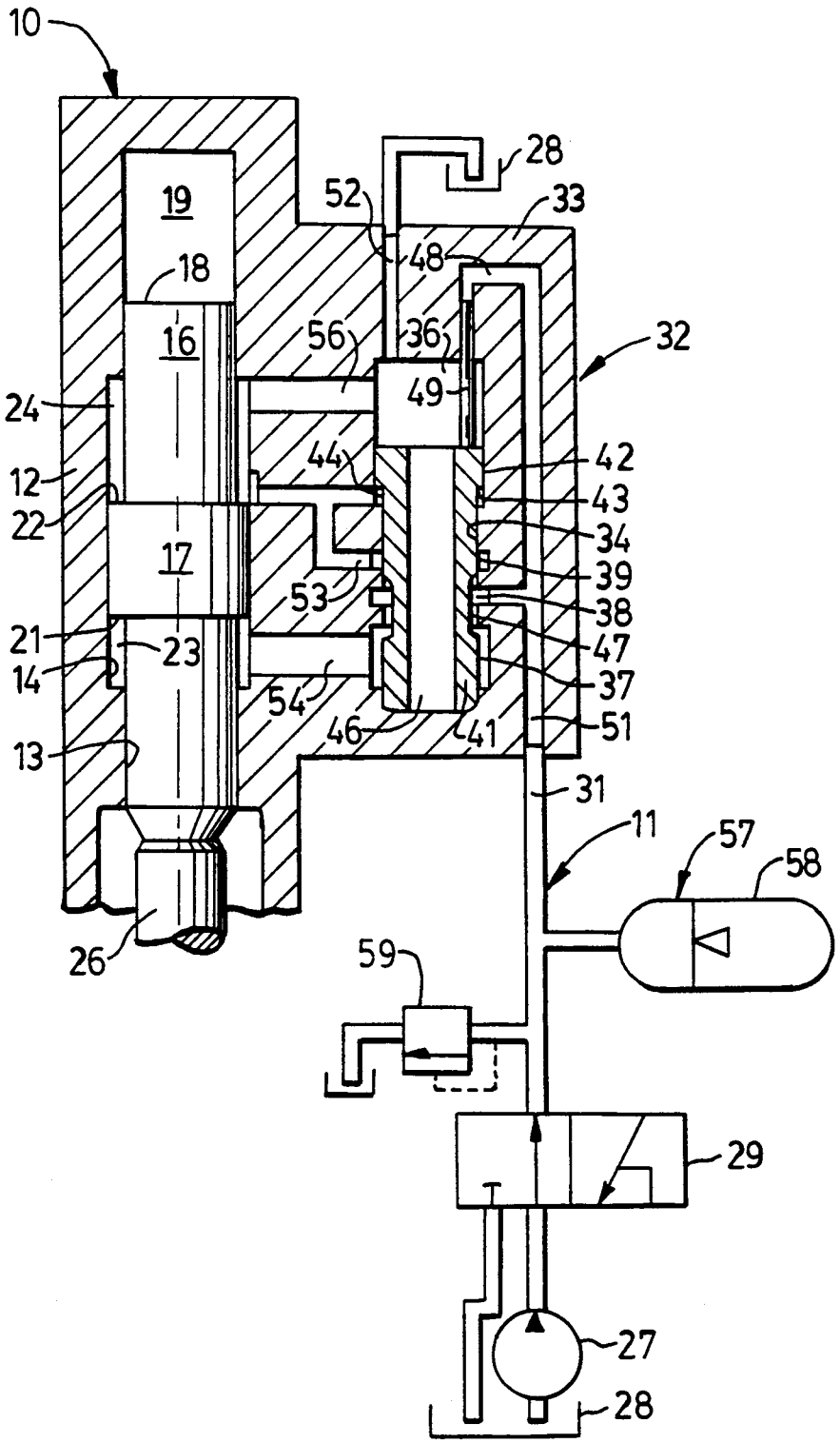
10
19
18
16
17
24
12
22
21
23
14
13
26
28
52
33
48
56
36
32
49
44
42
43
34
39
38
47
37
51
53
54
46
41
31
11
57
58
59
29
27
28

IMPACT HAMMER AND CONTROL ARRANGEMENT THEREFOR

TECHNICAL FIELD

This invention relates generally to an impact hammer and control arrangement therefor and more particularly to a control arrangement having a means for storing pressurized fluid during one sequence of operation and thereafter using the stored fluid in another sequence of operation.

BACKGROUND ART

Many hydraulic hammers have a hydraulic chamber which receives pressurized fluid from a hydraulic pump for moving a piston in a direction against a volume of compressible gas. Once the piston reaches a predetermined position, an actuating valve is automatically sequenced to a position for venting the hydraulic chamber, thereby allowing the compressed gas to rapidly propel the piston in an opposite direction against a cutting tool. The actuating valve of some of those hammers blocks the flow of fluid from the pump to the hammer during the propelling stroke of the piston. When this happens, the pressurized fluid is commonly relieved by a relief valve connected to the pump output conduit. This reduces the efficiency of the operation in several ways. First of all, since the pressure relieving setting of the relief valve must be higher than the normal operating pressure of the hammer, considerable energy must be expended to pump the fluid through the relief valve at such high pressure. Secondly, since the operating speed of the hammer is dependent upon the pump output, a larger pump is required since some of the pressurized fluid is not being utilized in the actual operation of the hammer.

One prior art reference relating to this general subject is U.S. Pat. No. 4,715,265, issued Dec. 29, 1987 to Graul et al. That system relates to an apparatus for vibratory operation of a working piston in which the piston is moved toward the tool by pressurized hydraulic fluid from a pump through an actuating valve. The actuating valve has an inlet port connected to the pump and alternately establishes and blocks communication of fluid through the valve from the pump to the actuating chamber. A pressure equalizing storage means or reservoir is also connected to the inlet port of the actuating valve. However, that reference fails to provide any functional use for such pressure equalizing storage means.

The present invention is directed to overcoming one or more of the above problems.

DISCLOSURE OF THE INVENTION

In one aspect of the present invention, an impact hammer and control arrangement therefor comprises a hydraulic impact hammer having a housing, a piston slidably disposed in the housing and having a pair of fluid engagement surfaces thereon, a variable volume gas chamber defined by the housing and one of the fluid engagement surfaces and filled with a pressurized gas, and a variable volume hydraulic chamber defined by the housing and the other of the fluid engagement surfaces. A source of pressurized fluid has a supply conduit connected thereto. An actuating valve is connected to the variable volume hydraulic chamber and to the supply conduit and is moveable between a first position at which pressurized fluid from the pump is directed into the hydraulic chamber to retract the piston against the bias of the pressurized gas and a second position at which the hydraulic chamber is vented and fluid flow through the actuating valve to the hydraulic chamber is blocked. A means is provided for storing pressurized fluid from the pump when the valve is in the second position and for supplementing the output of the pressurized fluid from the pump when the valve is in the first position.

BRIEF DESCRIPTION OF THE DRAWINGS

The sole figure is a schematic illustration of an embodiment of the present invention with portions shown in section for illustrative convenience.

BEST MODE FOR CARRYING OUT THE INVENTION

Referring to the drawing, a hydraulic hammer 10 is connected to a control arrangement 11. The hydraulic hammer 10 includes a housing 12 having a longitudinally extending stepped bore 13 with the stepped bore 13 having an enlarged intermediate section 14. A piston 16 is slidably disposed in the bore 13 and has a flange 17 slidably disposed within the enlarged intermediate section 14. The piston 16 has an end surface 18 which functions as a fluid engagement surface and cooperates with the housing 12 to define a variable volume gas chamber 19. The flange 17 has a pair of angular shoulders 21,22 which function as fluid engagement surfaces and cooperate with the housing to define a pair of annular variable volume hydraulic chambers 23,24 respectively at opposite ends of the flange 17. An impact transfer member 26 is positioned to receive impact blows from the piston 16 and is suitably connected to a work tool, not shown. The gas chamber 19 is filled with a pressurized gas in the usual manner.

The control arrangement 11 includes a source of pressurized hydraulic fluid such as a hydraulic pump 27 connected to a reservoir 28, a control valve 29 connected to the pump 27, and a supply conduit 31. The control valve 29 is moveable between a first position at which the pressurized fluid is directed from the pump 27 into the supply conduit 31 and a second position at which the pump 27 and supply conduit 34 are communicated with the reservoir 28.

An actuating valve 32 includes a body 33 connected to the housing 12 in the usual manner. The body 33 has a stepped bore 34 with the bore having an enlarged end section 36. A plurality of annuli 37,38,39 communicate with and are axially spaced along the stepped bore 39. A valve spool 41 is slidably positioned in the bore 34 and has a flange 42 disposed in the enlarged end section 36. The flange 42 has an annular shoulder 43 which functions as an actuating surface and cooperates with the body 33 to define an annular actuating chamber 44. The valve spool 41 has a longitudinally extending axially disposed passage 46 therein and an annular groove 47 formed on the outer periphery thereof. The body 33 has a bore 48 opening into the enlarged end section 36 of the bore 43. A plunger 49 is slidably disposed in the bore 48 and abuts the valve spool 41. The effective area of the annular shoulder 43 is greater than the effective area of the plunger 49. The body 33 also includes an inlet port 51 connected to the supply conduit 31 and being in communication with the annulus 38 and the bore 48. An exhaust port 52 connects the enlarged end section 36 with the reservoir 28. A signal passage 53 is in continuous communication with the actuating chamber 44 and with the annulus 39. Depending upon the position of the piston 16, the signal passage is also in communication with the hydraulic chamber 14, blocked by the flange 17 of the piston 16 or is in communication with the hydraulic chamber 23. A transverse passage 54 communicates the annulus 37 with the hydraulic chamber 23 while another transverse passage 56 communicates the hydraulic chamber 24 with the enlarged end section 36. The valve spool 41 is moveable between first and second positions. At the first position, the spool 41 communicates the inlet port 51 with the hydraulic chamber 23, blocks the inlet port from the annulus 39, and blocks the hydraulic chamber 23 from the exhaust port 52. At the second position, the hydraulic chamber 23 is in communication with the exhaust port 52 and the inlet port 51 is in communication with the annulus 39.

A means 57 is provided for storing pressurized fluid from the pump 27 when the valve spool 41 is in the second position and for supplementing the output of pressurized fluid from the pump when the valve spool 41 is in the first position. The means 57 can be, for example, an accumulator 58 connected to the supply conduit 31. A relief valve 59 is also connected to the supply conduit 31.

INDUSTRIAL APPLICABILITY

The valve spool 41 of the actuating valve 32 is shown in the first position and the piston 16 is shown in the extended position they would occupy immediately after the piston 16 has impacted the member 28. Thus, with the control valve 29 in the position shown, pressurized hydraulic fluid from the pump 27 is transmitted through the supply conduit 31, the inlet port 51, the annulus 38, the annular groove 47, the annulus 37, and the transverse passage 54 into the hydraulic chamber 23. The pressurized hydraulic fluid acting on the annular shoulder 21 retracts the piston 16, thereby compressing the gas in the chamber 19. As the piston 16 is retracted, the hydraulic fluid contained in the hydraulic chamber 24 is exhausted through the transverse passage 56, the enlarged end section 36 and the exhaust port 52 to the reservoir 28. When the piston 16 reaches a predetermined position at which the annular shoulder 21 clears the signal passage 53, communication is established between the hydraulic chamber 23 and the signal passage 53. High pressure hydraulic fluid is transmitted from the hydraulic chamber 23 into the actuating chamber 44 where it acts against the annular shoulder 43 of the valve spool 41, thereby moving the valve spool to the second position. With the valve spool in the second position, the stored energy in the compressed gas in the gas chamber 19 rapidly propels the piston 16 outwardly against the impact member 26. The fluid in the hydraulic chamber 23 passes through the transverse passage 54, the central passage 46, and the transverse passage 56 to fill the expanding chamber 24 behind the moving piston. Any excess fluid passes through the exhaust port 57 to the reservoir 28.

During the outward movement of the piston 16, the flange 17 blocks communication between the signal passage 53 and the enlarged section 14 of the bore 13 so that pressurized fluid in the annulus 38 is transmitted into the actuating chamber 44 to hold the valve spool 41 in the second position. With the valve spool in the second position, the fluid flow from the pump 27 to the hydraulic hammer is substantially blocked. However, under this condition the pressure of the fluid in the supply conduit 31 increases causing the fluid from the pump 27 to enter the accumulator 58 which stores the fluid during the time that the piston 16 is being propelled outwardly by the gas charge. When the annular shoulder 22 passes the opening of the signal passage 53, communication is momentarily established between the actuating chamber 44 and the reservoir 28. The size of the signal passage 53 is selected to restrict fluid flow therethrough to create a back pressure in the inlet port 51 and bore 48 sufficient to cause the plunger 49 to move the valve spool 41 to the first position. When the valve spool reaches the first position, communication is again established between the inlet port 51 and the actuating chamber 23. Under this condition, the pressurized fluid stored in the accumulator supplements the flow from the pump 27 to again retract the piston 16 with the cycle being repeated as long as the control valve 29 remains in the position shown.

The accumulator 58 is preferably preloaded sufficient to prevent the entrance of fluid thereinto during the time when the piston 16 is being retracted against the gas charge in the gas chamber 19. The accumulator has a capacity sufficient to store the total output of the pump 27 during the time that the actuating valve spool 41 is in the second position.

In view of the foregoing, it is readily apparent that the structure of the present invention provides an improved hydraulic hammer and control arrangement therefor which increases the operating efficiency by storing pressurized fluid from the pump during periods when the output of the pump is blocked from the hammer by the actuating valve. Also since the stored pressurized fluid is then used to supplement the fluid flow from the pump during the retracting stroke of the piston, a smaller pump can be used to achieve the same frequency of hammer operation.

Other aspects, objects, and advantages of this invention can be obtained from a study of the drawing, the disclosure, and the appended claims.

I claim:

1. An impact hammer and control arrangement therefor, comprising:

a hydraulic impact hammer having a housing, a piston slidably disposed in the housing and having a pair of fluid engagement surfaces thereon, a variable volume gas chamber defined by the housing and one of the fluid engagement surfaces and filled with a pressurized gas, and a variable volume hydraulic chamber defined by the housing and the other of the fluid engagement surfaces;

a source of pressurized fluid;

a supply conduit connected to the source of pressurized fluid;

an actuating valve connected to the variable volume hydraulic chamber and to the supply conduit and being moveable between a first position at which pressurized fluid from the source of pressurized fluid is directed into the hydraulic chamber to retract the piston against the bias of the pressurized gas in the gas chamber and a second position at which the hydraulic chamber is vented and fluid flow from the source of pressurized fluid through the actuating valve is blocked; and means for storing pressurized fluid from the source of pressurized fluid when the actuating valve is in the second position and for supplementing the flow of pressurized fluid from the source of pressurized fluid when the actuating valve is in the first position said means including an accumulator connected to the supply conduit, and is preloaded sufficient to prevent the entrance of fluid thereinto during the time when the piston is being retracted against the gas charge in the gas chamber.

2. The hydraulic hammer and control arrangement therefor of claim 1 wherein the accumulator has a capacity sufficient to store the total output of the pump during the time that the actuating valve is in the second position.

* * * * *